US005709194A

United States Patent [19]

Moncelle

[11] Patent Number: 5,709,194

[45] Date of Patent: Jan. 20, 1998

[54] METHOD AND APPARATUS FOR INJECTING FUEL USING CONTROL FLUID TO CONTROL THE INJECTION'S PRESSURE AND TIME

[75] Inventor: Michael E. Moncelle, Bloomington, Ill.

[73] Assignee: Caterpillar Inc., Peoria, Ill.

[21] Appl. No.: 762,093

[22] Filed: Dec. 9, 1996

[51] Int. Cl.[6] ..... F02M 41/00

[52] U.S. Cl. ..... 123/446; 123/467; 239/96

[58] Field of Search ..... 123/446, 447, 123/467, 510, 511, 500–2, 575; 239/96, 585.2

[56] References Cited

U.S. PATENT DOCUMENTS

| | | | |
|---|---|---|---|
| Re. 33,270 | 7/1990 | Beck et al. | 123/447 |
| 3,610,529 | 10/1971 | Huber | 239/96 |
| 3,943,901 | 3/1976 | Takahashi et al. | 123/139 |
| 4,069,800 | 1/1978 | Kanda et al. | 123/139 |
| 4,271,807 | 6/1981 | Links et al. | 123/506 |
| 4,418,867 | 12/1983 | Sisson | 239/88 |
| 4,426,977 | 1/1984 | Taplin et al. | 123/446 |
| 4,440,132 | 4/1984 | Terada et al. | 123/446 |
| 4,448,169 | 5/1984 | Badgley et al. | 123/467 |
| 4,459,959 | 7/1984 | Terada et al. | 123/446 |
| 4,475,515 | 10/1984 | Mowbray | 123/467 |
| 4,572,136 | 2/1986 | Takeuchi et al. | 123/447 |
| 4,603,671 | 8/1986 | Yoshinaga et al. | 123/467 |
| 4,665,881 | 5/1987 | Wade | 123/557 |
| 4,811,715 | 3/1989 | Djorddjevic | 123/447 |
| 4,976,244 | 12/1990 | Eckert | 123/501 |
| 5,245,953 | 9/1993 | Shimada et al. | 123/575 |
| 5,509,391 | 4/1996 | DeGroot | 123/467 |
| 5,529,024 | 6/1996 | Wirbeleit et al. | 123/25 |
| 5,615,656 | 4/1997 | Mathis | 123/447 |
| 5,622,152 | 4/1997 | Ishida | 123/467 |

*Primary Examiner*—Thomas N. Moulis
*Attorney, Agent, or Firm*—J. W. Keen

[57] ABSTRACT

An improved electronically-controlled heavy fuel oil (HFO) injection system comprises a pumping chamber for pressurizing fuel and a direct-operated check for controlling fuel injection. A control fluid different from the fuel is used to operate regulating apparatus for controlling the fuel injection pressure and fuel injection timing. The regulating apparatus isolate the HFO from sensitive mechanisms by appropriate exposure of the control fluid to flush intruding HFO from those mechanisms. Pressurization of fuel begins before the start of fuel injection. Fuel injection is initiated by exposing one end of the check to low pressure control fluid while the other end is exposed to high pressure fuel. Fuel injection is terminated by exposing the one end to high pressure control fluid to hydraulically balance the check and allow a biasing device to close the check.

The present invention provides improved control of several fuel injection parameters, including higher peak fuel injection capability and faster fuel injection pressure drop at the end of injection, resulting in improved engine performance and reduced emissions, noise, and wear.

16 Claims, 7 Drawing Sheets

METHOD AND APPARATUS FOR INJECTING FUEL USING CONTROL FLUID TO CONTROL THE INJECTION'S PRESSURE AND TIME

TECHNICAL FIELD

The present invention relates generally to fuel injectors and, more particularly, to fuel injectors having non contacting valve closing orifice structure.

BACKGROUND ART

Previous fuel oil injectors have had problems with injecting heavy fuel oil due to its high viscosity and have often required regular servicing to prevent the corrosion and sticking of moving parts within the fuel injectors due to the nature of the heavy fuel oil. Heavy fuel oil has extremely high viscosity levels when cold and must be heated before injecting. This has the disadvantage of reducing the life of any electronic components within the heavy fuel oil injector.

Starting an engine on heavy fuel oil is also a significant problem. Unheated heavy fuel oil inhibits operation of control valves associated with the fuel injector due to the fuel's sticky and/or high viscosity nature.

Another problem with the injection of heavy fuel oil into an internal combustion engine is the chemical interaction of engine lubricating oil with the heavy fuel oil. In time, such interaction enables formation of calcium carbonate deposits on the plunger and barrel components of previous fuel injectors used in heavy fuel oil applications.

In previous heavy fuel oil injectors, a cooling circuit was typically provided around the injector's nozzle tip necessitating larger bores in the engine's cylinder head to insert the nozzle. Such larger bores occupied more space than normal on the utilizing engine's cylinder head and, thus, minimized the area available for engine intake and exhaust valves.

The present invention is directed to overcoming one or more of the problems as set out above.

DISCLOSURE OF THE INVENTION

In one aspect of the present invention there is provided a fuel injector including a pressurizing device having a reciprocatable member and a pressurizing chamber into which the member is movable, a housing having a bore, a check control chamber, and an orifice, a check reciprocatably arranged in the bore to move between a first position and a second position and having a first and a second end which respectively include a control area and an opening area with the opening area being fluidly coupled to the pressurizing chamber and the control area being fluidly coupled to the check control chamber wherein the chambers are fluidly isolated, and a pressure control valve for regulating the pressure in the pressurizing chamber and a check control valve for regulating the pressure in the check control chamber.

In another aspect of the invention there is provided a fuel injection system including a source of fuel, a source of control fluid, a pressurizing housing having a bore, a movable plunger arranged in the bore and a pressurizing chamber, an injection housing having a check bore and an orifice, a movable check arranged in the check bore to move between first and second positions respectively blocking and providing fluid communication between the check bore and the orifice, a check control valve providing fluid communication between the check control chamber and one of the control fluid source and a drain for moving the check between its first and second positions, and a pressure control valve for selectively providing and obstructing fluid communication between the fuel source and the pressurizing chamber.

In a third aspect of the present invention there is provided a method of injecting fuel including the steps of providing a fuel supply, a control fluid supply passage and drain, a check control chamber, a pressure control valve for selectively providing and obstructing fluid communication therethrough, and a check control valve for selectively providing and obstructing fluid communication therethrough, moving a plunger within a housing in a first direction to expel fuel from a pressurizing chamber to the fuel supply passage, providing fluid communication between the pressure control valve and the drain, providing fluid communication between the supply passage and pressure control valve after a predetermined pressure is reached in the pressurizing chamber, providing fluid communication between the drain and check control chamber, providing fluid communication between the drain and check control chamber, providing fluid communication between the supply passage and the pressure control valve, and moving the plunger in a second direction to depressurize fuel in the pressurizing chamber.

BEST MODE FOR CARRYING OUT THE INVENTION

Figure 1A:
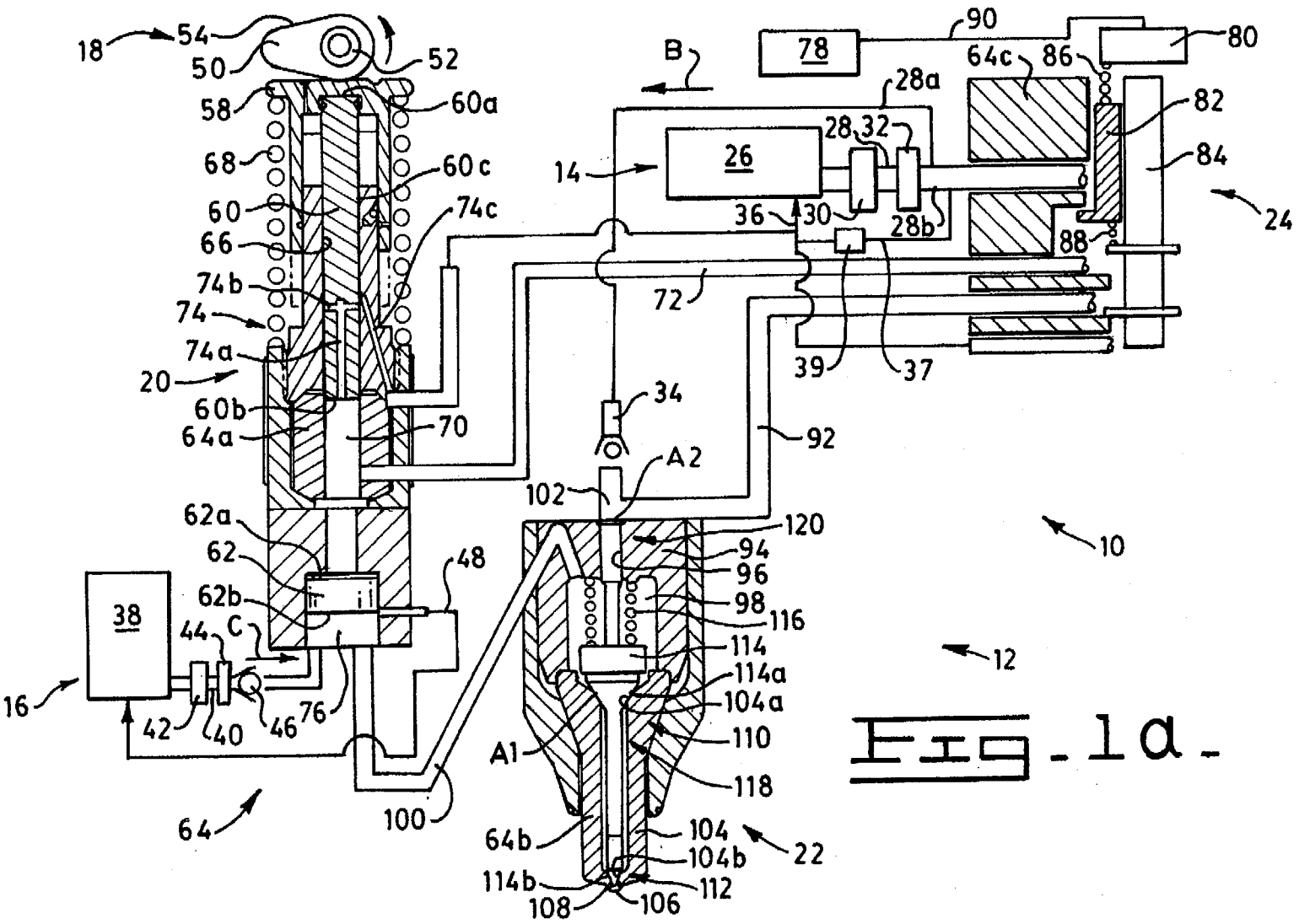
FIGS. 1*a* and 1*b* are diagrammatic, general schematic views of an electronically-controlled fuel injection system of the present invention respectively illustrating various components thereof in their first and second positions.
Figure 1B:
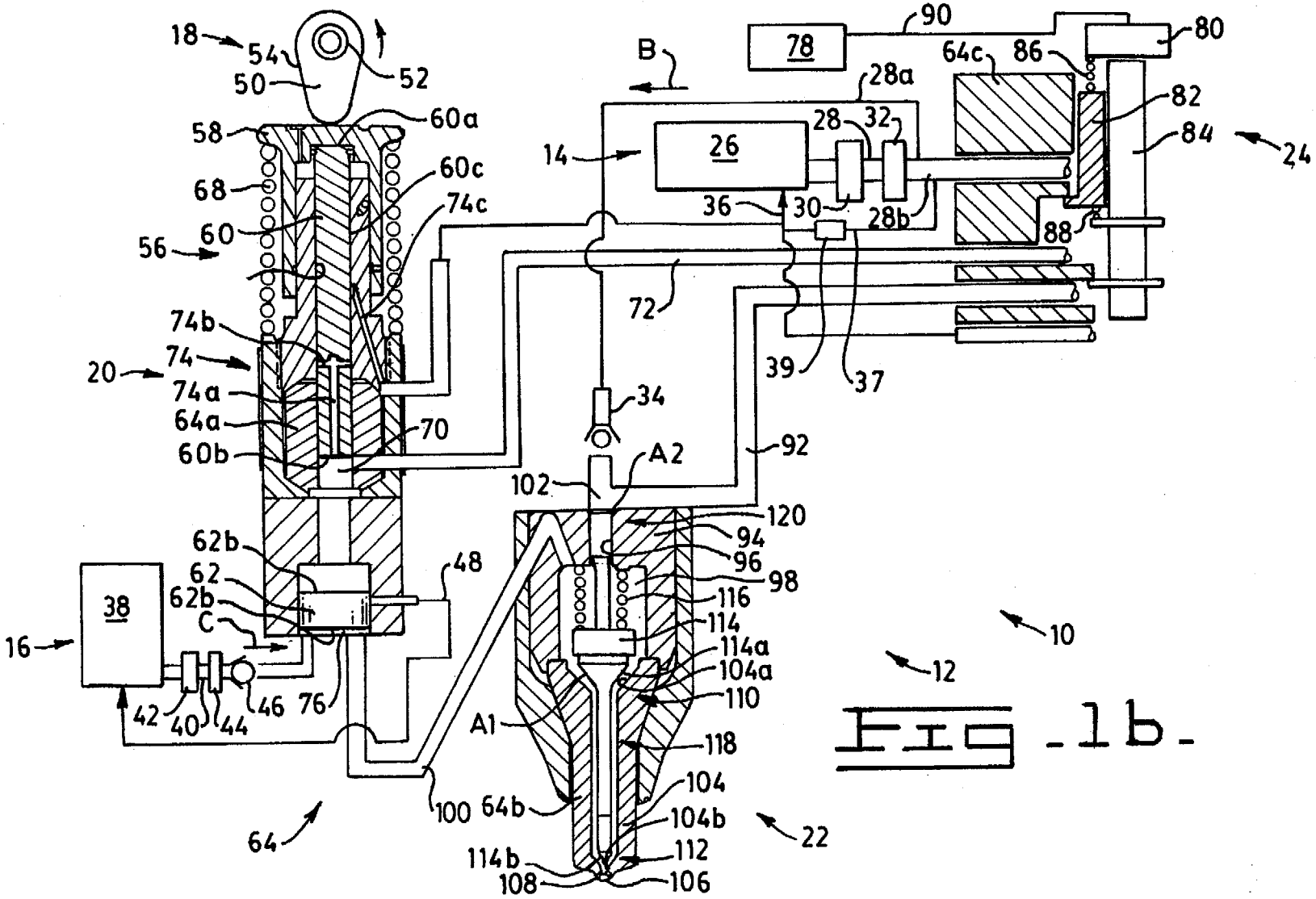
Figure 2A:
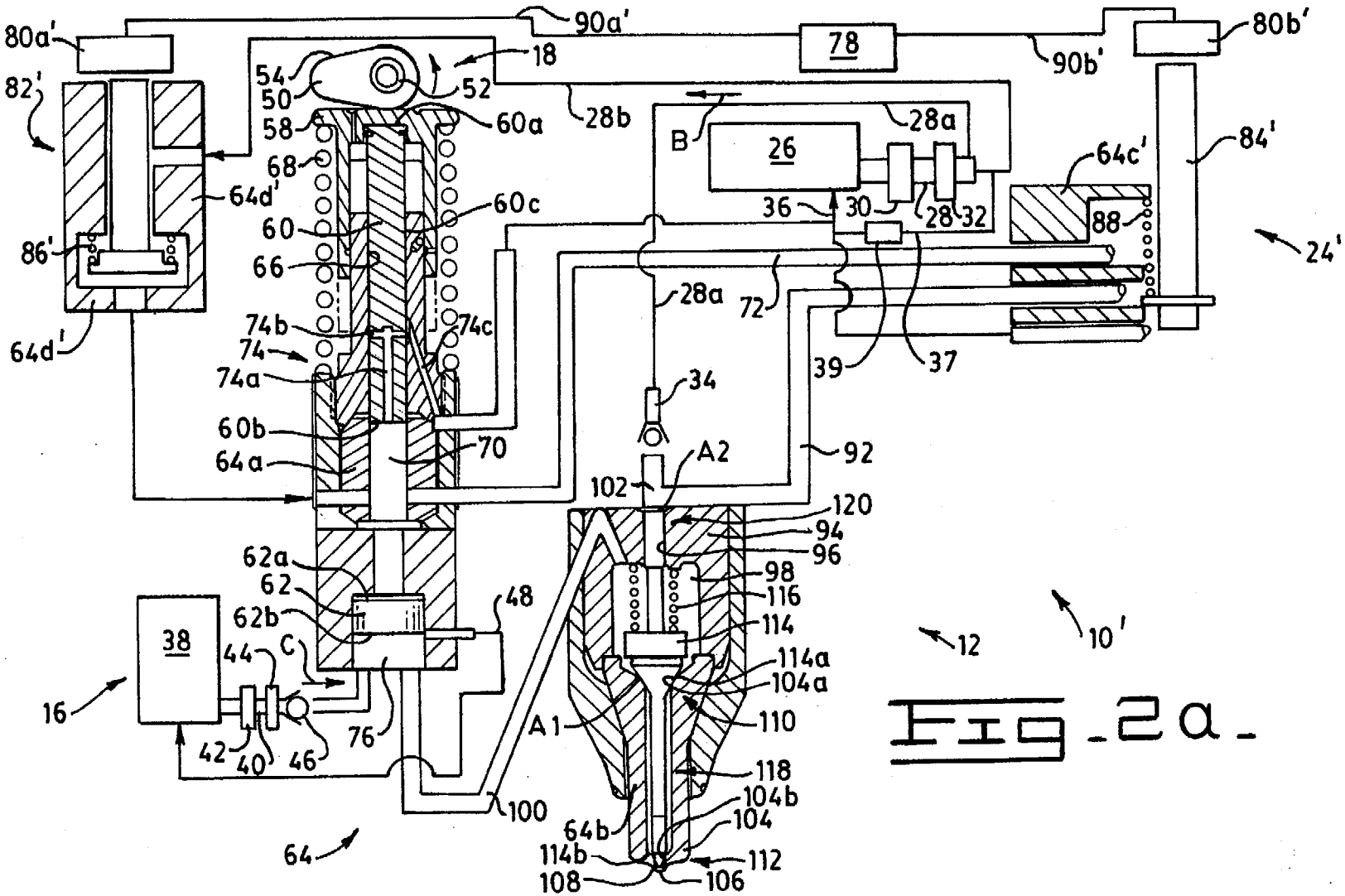
FIGS. 2*a* and 2*b* are diagrammatic, general schematic views of a second embodiment of an electronically-controlled fuel injection system of the present invention respectively illustrating various components thereof in their first and second positions.
Figure 2B:
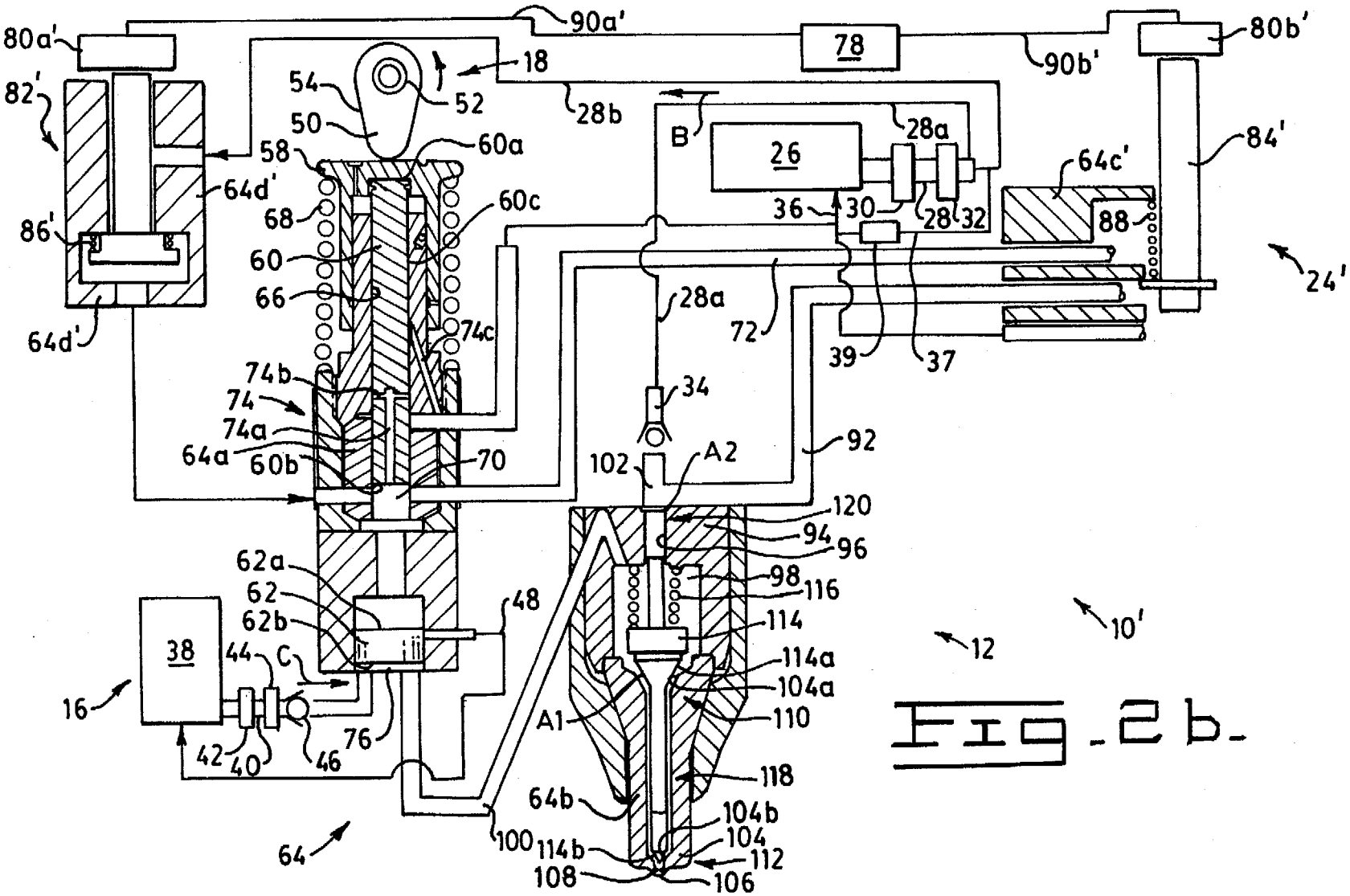
Figure 3A:
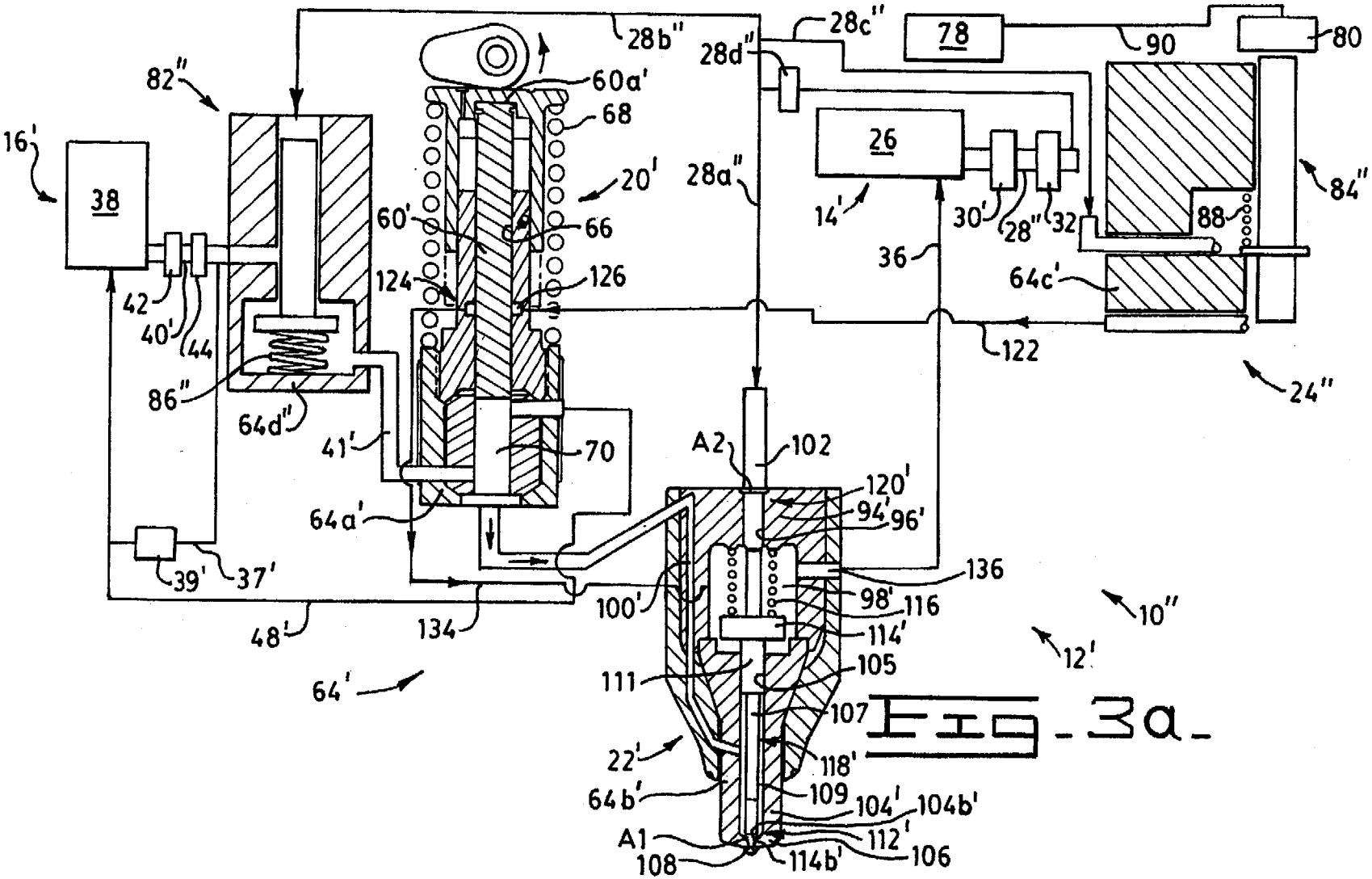
FIGS. 3*a* and 3*b* are diagrammatic, general schematic views of a third embodiment of an electronically-controlled fuel injection system of the present invention respectively illustrating various components thereof in their first and second positions.
Figure 3B:
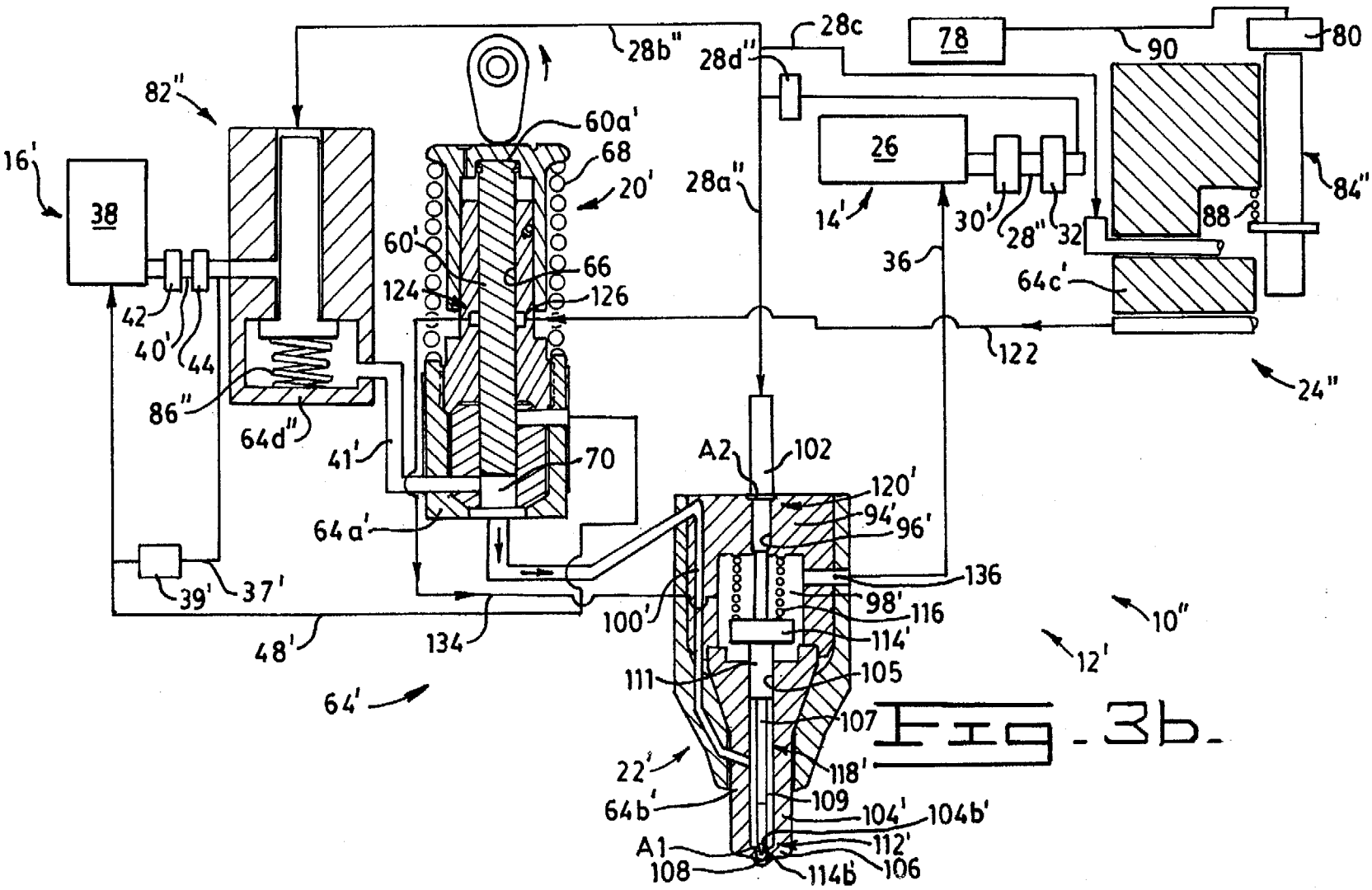

Referring to FIGS. 1*a*, 1*b*, 2*a*, 2*b*, 3*a*, and 3*b*, wherein similar reference numerals designate similar elements or features throughout the Figures, there are schematically shown three embodiments of an electronically-controlled high viscosity fuel injection system 10, 10', 10" of the present invention (each is hereinafter referred to as an HFO fuel system). Many elements of the HFO fuel system move between first and second positions which will be described in greater detail hereinafter. Although such first positions are illustrated in FIGS. 1*a*, 2*a*, and 3*a* and such second positions are illustrated in FIGS. 1*b*, 2*b*, and 3*b*, it is to be understood that the relative positions/states of the elements actually change during an injection cycle in accordance with the description which follows.

The HFO fuel system 10 is schematically illustrated in FIGS. 1*a* and 1*b* and includes a fuel injector 12, apparatus or means 14 for supplying control fluid such as distillate fuel to the injector 12, apparatus or means 16 for supplying heavy fuel oil (HFO) to the injector 12, and apparatus or means 18 for actuating the injector 12. The injector 12 generally includes apparatus or pressurizing means 20 for pressurizing the HFO, apparatus or means 22 for injecting pressurized HFO into an engine's combustion chamber, and apparatus or means 24 for electronically controlling the injection pressure and injection timing of HFO. While only a single injector 12 is illustrated in each of the fuel systems 10, 10', 10", it is to be understood that typical HFO fuel systems will include multiple injectors each of which supplies fuel to a respective engine combustion chamber. For such multiple combustion chamber engines employing HFO injection systems, apparatus 14–18 are associated with all injectors 12. For purposes of simplicity, however, only one injector 12 and its associated apparatus 14–18 are shown.

The control fluid supply means 14 preferably includes a distillate fuel tank 26, a fluid supply/passage 28 having one end connected to the fluid tank 26 and having a second end which bifurcates to fuel supply/passages **28*a* and 28*b*, a relatively low pressure fluid transfer pump 30, one or more filters 32, a check valve 34 disposed on the fluid supply/passage 28*a* to ensure flow therethrough in a direction B, a fluid drain/passage 36 arranged to provide fluid communication between various components (to be described hereinafter) and the distillate fuel tank 26, a relief line 37 connecting supply/passage 28*b* to the drain/passage 36, and a pressure relief valve 39 which permits fluid flow through relief line 37 when pressure in 28*b*** exceeds a predetermined magnitude.

The HFO supply means 16 preferably includes an HFO tank 38, an HFO supply/passage 40 providing fluid communication between the HFO tank 38 and the pressurizing means 20, a relatively low pressure HFO transfer pump 42 for pumping HFO through the HFO supply/passage 40 from the HFO tank 38, at least one HFO filter 44 for filtering the HFO pumped through the HFO supply/passage 40, a check valve 46 for ensuring HFO flow through the HFO supply/passage 40 in a direction C, and an HFO drain/passage 48 arranged to provide fluid communication between the pressurizing means 20 and the HFO tank 38.

The actuating means 18 of the Figures includes a cam 50 which is mounted on an engine-driven, rotatable camshaft 52 and has a cam surface 54 which has a profile, from the perspective of the Figures, which depends upon, among other things, the desired actuation timing of the injector, type and shape of the cooperating, engaged surface, engine speed, and desired range of operational fuel injection pressure.

An alternate actuating means 18 comprises a hydraulically driven device as shown and described in, for example, U.S. Pat. No. 5,191,867 issued Mar. 9, 1993, and assigned to the assignee of the present invention.

The pressurizing means 20 of the Figures includes a tappet/plunger assembly 56 having a tappet 58 and a first pressurization member or plunger 60 which are joined in any suitable manner. The pressurizing means 20 also includes a second pressurization member or slave piston 62 having opposite ends, **62*a* and 62*b*, each with a surface area A3, a housing 64*a* having a bore 66 within which the plunger 60 and slave piston 62 are disposed, and a biasing member or spring 68 for biasing the tappet/plunger assembly 56 away from the housing 64*a* to ensure continued engagement between the cam 50 and tappet 58 regardless of the rotational position of the cam 50. The plunger 60, housing 64, and bore 66 cooperatively define a pumping chamber 70 which is in fluid communication with the slave piston end 62*a*. The plunger 60 has a first end 60*a* adjacent the tappet 58, a second end 60*b* which helps define the pumping chamber 70, and an outer peripheral, guide surface 60*c* which slidably engages the housing 64*a*. A fluid control passage 72 constitutes a part of the pressurizing means 20 and provides fluid communication between the pumping chamber 70 and the electronic control means 24**.

A fluid passage circuit 74 includes a longitudinal passage **74*a*, a transverse passage/annulus 74*b*, and a vent passage 74*c*. The longitudinal passage 74*a* extends longitudinally in the plunger 60 from the plunger end 60*b* to the transverse/annular passage 74*b* which extends to the peripheral guide surface 60*c* and is preferably in the form of an annulus at the guide surface 60*c*. The vent passage 74*c* extends through the housing 64 to provide fluid communication between the drain/passage 36 and, when the plunger 60 is in its fully retracted, first position, the transverse passage 74*b*. The housing 64*a* and the slave piston end 62*b* cooperatively define an HFO injection chamber 76 whose maximum size occurs upon maximum retraction of the slave piston 62 towards the pumping chamber 70 which is in fluid communication with the slave piston end 62*a*. Such maximum size depends upon, among other things, the desired maximum fuel quantity to be injected during an injection cycle, the desired peak fuel injection pressure during an injection cycle, the desired fuel injection pressure during an injection cycle, the bulk modulus of the fuel to be injected, and the desired displacement of the slave piston 62. The injection chamber 76 is in fluid communication with the HFO supply/passage 40 and, when the slave piston 62 has been retracted to its first position, the HFO drain/passage 48. The slave piston 62 reciprocates between a first, fill position and a second, stop injection position in response to the pressure within the pumping chamber 70 and the injection chamber 76**.

The electronic control means 24 preferably includes an electronic control module (ECM) 78 which controls the following parameters: 1) the HFO injection timing; 2) the HFO quantity during an injection cycle; 3) the HFO injection pressure; 4) the number of separate injections where multiple injections are required during an individual injection cycle; 5) the time interval between separate HFO injections; 6) the fuel quantity of each HFO injection during an injection cycle; and 7) any combination of the above parameters among a plurality of injectors 12. Each of the above parameters is variably controllable independent of the utilizing engine's speed and loading.

The control means 24 generally includes an actuator such as solenoid 80, a pressure control valve 82, a check control valve 84, a biasing device or pressure control spring 86 for biasing the pressure control valve 82 to its first, open position, and a biasing device or check control spring 88 for biasing the pressure control valve 82 to its second, closed position and for biasing the check control valve 84 to its first, pressurizing position.

The ECM 78 selectively controls the position of the pressure control valve 82 and the check control valve 84 by sending appropriate signals via a conductor 90 to energize or de-energize the actuator 80. Although the actuator 80 preferably constitutes a single solenoid 80, the actuator 80 may constitute any suitable electrically actuated device such as a piezo-electric device 80.

The pressure control valve 82 is selectively movable between a de-energized, first, open position and an energized, second, closed position. At its first position, the pressure control valve 82 provides fluid communication between the fluid supply means 14 and the pumping chamber 70 by fluidly connecting the fluid supply/passage 28*b* and the control passage 72. The pressure control valve 82 may be moved from its first position to its second position by energizing the solenoid 80. At its second position, the pressure control valve 82 blocks fluid communication through control passage 72 between the fluid supply means 14 and the pumping chamber 70.

The check control valve 84 is selectively movable between a first, injection prevent position and a second, injection enable position and constitutes a three-way popper, spool, or other type of valve. The check control valve 84: at its first position, blocks fluid communication between a check control passage 92 (which comprises a part of the injecting means 22) and the fluid drain/passage 36 and provides fluid communication between the check control passage 92 and the fluid control passage 72; and, at its second position, provides fluid communication between the check control passage 92 and the fluid drain/passage 36 and blocks fluid communication between the check control passage 92 and the fluid control passage 72.

The check control spring 88 is arranged to bias the pressure control valve 82 towards its second, closed position and the check control valve 84 towards its first position. The force of the spring 88 is selected to return the check control valve 84 from its second, drain position to its first, pressurizing position when the solenoid 80 is de-energized. The force of the spring 88 is chosen such that when the pressure control valve 82 is in its second, closed position and the pressure in the pumping chamber 70 is reduced, the pressure from the fluid supply means 14 overcomes the force exerted by the spring 88 and moves the pressure control valve 82 to its first, open position allowing the control fluid (distillate fuel in the illustrated case) to flow from the fluid supply means 14 through the fluid control passage 72 to the pumping chamber 70. The actuator 80 and valves preferably occupy a housing 64*c*.

It is to be understood, however, that actuator 80 could include dual armatures each of which separately controls the valves 82 and 84 rather than the illustrated, single armature equipped actuator 80 and the associated interconnected valve structure which causes valve 82 to move to its second position when valve 84 moves to its second position.

Figure 5A:
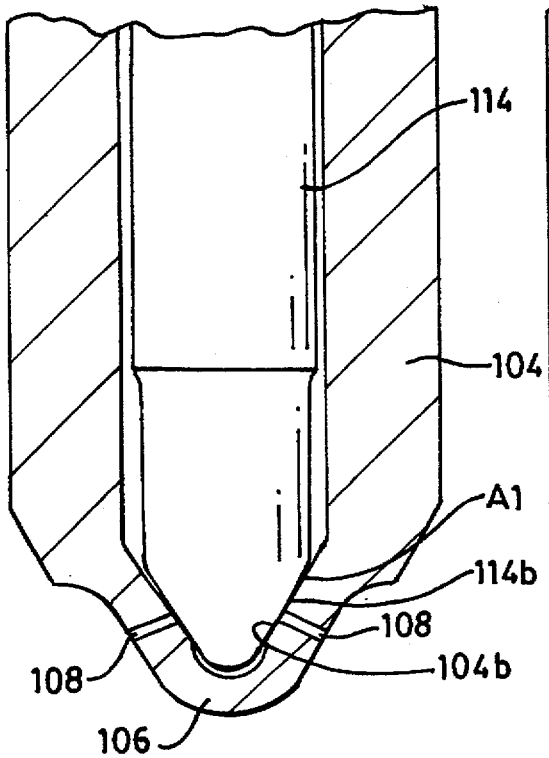
FIGS. 5*a* and 5*b* are enlarged, semi schematic views of a portion of the nozzle and check structure of FIGS. 1 and 2 respectively illustrating the check in its closed and open position.
Figure 5B:
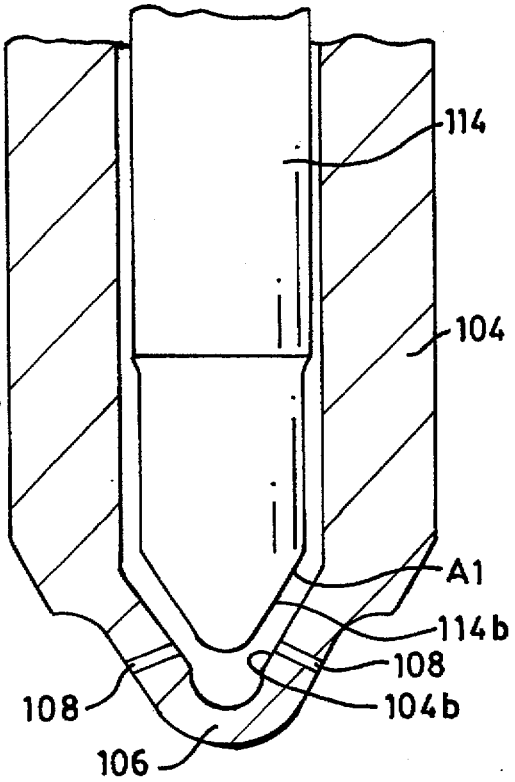

The injecting means 22 includes a check guide body 94, a check guide bore 96 therein, a check guide chamber 98 integral with or, as illustrated in FIG. 1, arranged in fluid communication through an injection passage 100 with the injection chamber 76, a check control chamber 102, a nozzle structure 104 having a tip 106 and at least one fuel injection orifice 108 extending through the tip 106, a primary seating structure 110 disposed distally relative to the tip 106, a secondary seating structure 112 disposed proximally relative to the tip 106, a check 114 reciprocatably disposed in the check guide bore 96 to sealingly separate the check control chamber 102 from the check guide chamber 98, and a check spring 116 biasing the check 114 to its first position. The nozzle structure 104 and check 114 for fuel systems 10 and 10' near the tip 106 and secondary seating structure 112 are better seen in FIGS. 5*a* and 5*b*.

The primary seating structure 110 preferably includes a conical surface 114*a* on check 114 and a conical surface 104*a* on the nozzle structure 104 with the conical surface 114*a* having a smaller cone angle than the conical surface 104*a* to ensure engagement therebetween. The secondary check seating structure 112 preferably includes a conical surface 114*b* on the check 114 and a conical surface 104*b* on the nozzle structure 104 with the conical surface 114*b* having a smaller cone angle than the conical surface 104*b* to ensure engagement therebetween when the check 114 is in its first, closed position. The surfaces of the primary seating structure 110 are designed to engage with a greater force (F110) than are the surfaces of the secondary seating structure 112 (F112). The injection orifice(s) 108 are designed to be as close as possible to the primary conical check surface 114*a* and secondary conical check surface 114*b* when the check occupies its first position (described later) so as to minimize the effective injector sac volume (normally referred to as a valve closing orifice nozzle).

The surfaces of the primary seating structure 110 are designed to engage with a greater force (F110) than are the surfaces of the secondary seating structure 112 (F112). The primary seating structure 110 is designed to accept a greater proportion of the total force of engagement (F110+F112) on the seating structures 110 and 112. Preferably, the secondary seating structure 112 will have minimal to zero engagement force (sometimes referred to as non-contacting valve closing orifice) when the injector 12 is at normal operating temperatures. The valve closing orifice configuration minimizes the fuel exposed to the engine's combustion chamber after normal injection thus reducing combustion emissions and smoke. Little or no engagement force on the secondary seating structure 112 drastically reduces the stress levels imposed on the nozzle tip 106. Such lower stress levels permits elimination of tip cooling circuits which are common for HFO fuel systems due to the elevated injector operating temperatures necessary to make HFO flow readily. Such cooling circuit elimination reduces the size of each injector's opening into the combustion chamber which, in turn, permits larger and/or more exhaust/intake valves to be used for each combustion chamber resulting in improved engine performance.

The secondary seating structure 112 is designed to accept a greater proportion of the total force of engagement at lower injector operating temperatures (i.e., not at normal operating temperatures) due to the relative length changes between the nozzle structure 104 and the check 114. At such lower operating temperatures, however, the engagement force on the secondary seating structure 112 remains, preferably, less than the engagement force on the primary seating structure 110.

The direct operated check 114 is selectively movable between a first, non-injecting position and a second, injecting position which, respectively, block and open fluid communication between the check guide chamber 98 and the fuel injection orifice(s) 108. The check 114 has a first end portion 118 and a second end portion 120. The first end portion 118 includes the conical surface 114*a* which has a first effective area A1 which is in fluid communication with the check guide chamber 98 when the check 114 occupies its, first, non-injecting position. The second end portion 120 defines a second effective area, A2, which, when exposed to pressure, exerts a force on the check 114 to bias same to its first position and which is in continuous fluid communication with the check control chamber 102.

When the check 114 occupies its first position and the check control valve 84 occupies its second position, the check's first and second effective areas, A1 and A2, are exposed to and acted upon by the pressure resident in chambers 98 and 102, respectively, to hydraulically bias the check 114 to its second position against the biasing force exerted by the check spring 116 in the usual way to inject fuel residing in the guide chamber 98. When the check 114 is at its second position and the check control valve 84 is at its first position, the first and second effective areas, A1 and A2, are acted upon by the pressure resident in chambers 98 and 102, respectively, to hydraulically balance the forces on the check 114 and thereby allow the check spring 116 to move the check 114 towards its first position.

The check guide body 94 and nozzle structure 104 together comprise a part of a housing 64*b*. The injector 12 is preferably a unit injector wherein the housing 64*a*, the housing 64*b*, and the housing 64*c* constitute portions of a unitized housing structure 64. Alternatively, the injector 12 could be of modular construction with the injecting means 22 being physically separated from the pressurizing means 20 and/or also separated from the control means 24. Separation of the means or injector portions 20, 22, and/or 24 may advantageously be provided to accommodate spatial limitations in and around the utilizing engine. When pressurizing means 20 is physically separated from the injecting means 22, the pressurizing means 20 is sometimes referred to as an electronic unit pump (EUP) 20.

A second embodiment of an HFO injection system 10' is shown in FIGS. 2*a* and 2*b*. The HFO injection system 10' is the same as HFO injection system 10 with the following exceptions: the fluid supply means 14 is in fluid communication with a modified control means 24' instead of the control means 24; the modified control means 24' includes (1) a pressure control valve 82' which selectively blocks fluid communication between the fluid supply means 14 and the pressurizing means 20, (2) an actuator or solenoid 80*b*' which controls the pressure control valve 82', (3) a check control valve 84', (4) a solenoid 80*b*' which controls the check control valve 84', (5) an electronic control module (ECM) 78, (6) a pressure control spring 86' for biasing the pressure control valve 82' to its first, open position, (7) a check control spring 88' for biasing the check control valve 84' to its first, open position, and (8) conductors 90*a*' and 90*b*' providing electrical communication between the ECM 78 and the solenoids 80*a*' and 80*b*', respectively; and a housing 64*d*' and a housing 64*c*' constitute a part of the pressure control valve 82' and the check control valve 84', respectively. It is to be understood, however, that the actuators 80*a*' and 80*b*' could constitute a single solenoid having dual armatures—each of which controls one of the valves 82',84'. Moreover, the pressure control valve 82' and check control valve 84' may occupy the same housing 64*c*'.

A third embodiment of an HFO injection system 10" is schematically shown in FIGS. 3*a* and 3*b* and includes a fuel injector 12', apparatus or means 14' for supplying high pressure fluid such as distillate fuel to the injector 12', apparatus or means 16' for supplying heavy fuel oil to the injector 12', and apparatus or means 18 for actuating the injector 12'. The injector 12' generally includes apparatus or pressurizing means 20' for pressurizing the HFO, apparatus or means 22' for injecting pressurized HFO into an engine's combustion chamber, and apparatus or means 24" for electronically controlling the injection pressure and injection timing of HFO.

The fluid supply means 14' preferably includes a fluid tank 26, a fluid supply/passage 28" having one end connected to the tank 26 and having a second end which bifurcates to fluid supply/passages 28*a*" and 28*b*", a control fluid pump 30' having a relatively high output pressure (about 4,000 psi), one or more fluid filters 32, and a fluid drain/passage 36 arranged to provide fluid communication between various components (to be described hereinafter) and the fluid tank 26. The fluid supply means 14' also includes a fluid drain passage 28*c*41 and a fluid control orifice 28*d*". The fluid drain passage 28*c*" fluidly connects the fluid passages 28*a*" and 28*b*" to the control means 24" and the control orifice 28*d*" restricts fluid flow through fluid supply/passage 28".

The HFO supply means 16' preferably includes an HFO tank 38, an HFO supply/passage 40' providing fluid communication between the HFO tank 38 and a pressure control valve 82" (to be described later), a supplemental HFO supply/passage 41' providing fluid communication between the pressure control valve 82" and the pressurizing means 20', a relatively low pressure HFO transfer pump 42 for pumping HFO through the HFO supply/passage 40' from the HFO tank 38, at least one HFO filter 44 for filtering the HFO pumped through the HFO supply/passage 40', and an HFO drain/passage 48' arranged to provide fluid communication between the pressurizing means 20' and the HFO tank 38, a relief line 37' connecting supply/passage 40' to the drain/passage 48', and a pressure relief valve 39' which permits HFO flow through relief line 37' when pressure in the HFO supply/passage 40' exceeds a predetermined magnitude.

The pressurizing means 20' includes a tappet/plunger assembly 56 having a tappet 58 and a first pressurization member or plunger 60' which are joined in any suitable manner. The pressurizing means 20' also includes a housing 64*a*' having a bore 66 therein and a biasing member or spring 68 for biasing the tappet/plunger assembly 56 away from the housing 64*a*' to ensure continued engagement between the cam 50 and tappet 58 regardless of the rotational position of the cam 50. The plunger 60', housing 64*a*', and bore 66 cooperatively define a pumping chamber 70. The plunger 60' has a first end 60*a*' adjacent the tappet 58, a second end 60*b*' which helps define the pumping chamber 70, and an outer peripheral, guide surface 60*c*' which slidably engages the housing 64*a*'. The maximum size of the pumping chamber 70 occurs when the plunger 60' occupies its first position which occurs upon the maximum retraction of the plunger 60' toward the camshaft 52 and depends upon, among other things, the desired maximum HFO quantity to be injected during an injection cycle, the desired peak fuel injection pressure during an injection cycle, the desired fuel injection pressure during an injection cycle, and the bulk modulus of the HFO to be injected.

The pumping chamber 70 is in fluid communication with the HFO supply/passage 41' and, when the plunger 60' has been retracted to its first position, the HFO drain/passage 48'. The plunger 60' reciprocates between a first, fill position and a second, stop injection position in response to movement of the cam 50 and the pressure within the pumping chamber 70.

The electronic control means 24" preferably includes an electronic control module (ECM 78 which controls the following parameters: 1) the HFO injection timing; 2) the HFO quantity during an injection cycle; 3) the HFO injection pressure; 4) the number of separate injections where multiple injections are required during an individual injection cycle; 5) the time interval between separate HFO injections; 6) the fuel quantity of each HFO injection during an injection cycle; and 7) any combination of the above parameters among a plurality of injectors 12'. Each of the above parameters is variably controllable independent of the utilizing engine's speed and loading.

The injector 12' is preferably a unit injector wherein the housing 64*a*' of the pressurizing means 20, a housing 64*b*' of the injecting means 22', and a housing 64*c*' of the control means 24" together constitute portions of a housing 64' of the injector 12'. Alternatively, the injector 12' could be of modular construction with the injecting means 22' being physically separated from the pressurizing means 20' and/or also separated from the control means 24". Separation of the injector portions 20', 22', and/or 24" may advantageously be provided to accommodate spatial limitations in and around the utilizing engine. When pressurizing means 20' is physically separated from the injecting means 22', the pressurizing means 20' is sometimes referred to as an electronic unit pump (EUP) 20'.

The control means 24" generally also includes an actuator 80, a pressure control valve 82", a check control valve 84", a biasing device or spring 86" for biasing the pressure control valve 82" to its second, closed position, and a biasing device or spring 88" for biasing the check control valve 84" to its first, pressurizing position.

The ECM 78 selectively controls the position of the pressure control valve 82" and the check control valve 84", respectively, by energizing or de-energizing the actuator 80 via signals sent through the conductor 90. Although the electrical actuator 80 preferably constitutes a single solenoid 80, the actuator 80 may constitute a piezo-electric device 80. Of course, a second electrical actuator or a second armature on the illustrated actuator could be used to control the pressure control valve 82" in place of the illustrated supply passage **28*b*" and after suitable modification of the structure for the pressure control valve 82"**.

The pressure control valve 82" is selectively movable between a first, open position and a second, closed position. At its first position, the pressure control valve 82" provides fluid communication between the HFO supply means 16' and the pumping chamber 70 by fluidly connecting HFO supply/passage 40' and the supplemental HFO supply/passage 41'. The pressure control valve 82" may be moved from its first position to its second position by energizing the solenoid 80. At its second position, the pressure control valve 82" blocks fluid communication between the HFO supply means 16' and the pumping chamber 70.

The check control valve 84" is selectively movable between a first, injection prevent position and a second, injection enable position and preferably constitutes a two-way poppet, spool, or other type of valve. The check control valve 84": at its first position, blocks fluid communication between the check control passage **28*c*" and the drain/passage 36; and, at its second position, provides fluid communication between the fluid drain passage 28*c*" and the fluid drain/passage 36. The spring 88" biases the check control valve 84" towards its first position. The force of the spring 88" is selected to return the check control valve 84" from its second, injection enable position to its first, injection prevent position when the solenoid 80** is de-energized.

The force of the spring 86" is chosen such that when the pressure control valve 82" is in its second, closed position and the pressure in the pumping chamber 70 is greater than a predetermined magnitude, the pumping chamber pressure when added to the force from the spring 86" exerts sufficient force on the valve 82" to hold it in the second, closed position against the force exerted by the high pressure control fluid when the solenoid 80 is deenergized and the pressure in supply/passage **28*b*" increases due to control fluid no longer being drained through passage 28*c*", through valve 84", and eventually through drain line 36. Preferably the electrical actuating means 80 shares the housing 64*c*"**, but may, alternately, be mounted separately therefrom.

The injecting means 22' includes a check guide body 94', a check guide bore 96' therein, a check guide chamber 98', a check control chamber 102, a nozzle structure 104' having a tip 106 and at least one fuel injection orifice 108 extending through the tip 106, a seat structure 112', a check 114' reciprocatably disposed in the check guide bore 96' to separate the check control chamber 102 from the check guide chamber 98', and a spring 116 housed within the check guide chamber 98' for biasing the check 114' to its first position. The check 114' includes a first end portion 118' and a second end portion 120' respectively disposed adjacent the tip 106 and the check control chamber 102. The nozzle structure 104' has a bore 105 which, with a reduced segment 107 of the check's lower portion 120', defines a nozzle chamber 109 which is in fluid communication with the pumping chamber 70 via injection passage 100'. An enlarged segment 111 of the check's first end portion 118' sealingly reciprocates in the bore 105 during movement of the check 114' to largely obstruct fluid flow therebetween in either direction.

The seat structure 112' preferably includes a conical surface **114*b*' on check 114' and a conical surface 104*b*' on nozzle structure 104' with the conical surface 114*b*' having a smaller cone angle than the conical surface 104*b*'** to ensure uniform engagement therebetween.

The direct operated check 114' is selectively movable between a first, non-injecting position and a second, injecting position which, respectively, block and open fluid communication between the nozzle chamber 109 and the fuel injection orifice(s) 108. The check's second end portion 120' includes a second effective area A2 which is in fluid communication with the check control chamber 102. The first end portion 118' defines a first effective area, A1, in continuous fluid communication with the nozzle chamber 109.

When the check 114' occupies its first position, the check control valve 84" occupies its second position, and sufficient pressure exists in the injection chamber 109, the check's first and second effective areas, A1 and A2, are exposed to and acted upon by the pressure resident in chambers 109 and 102, respectively, to hydraulically move the check 114' to its second position against the biasing force exerted by the biasing device or spring 116 in the usual way to inject fuel. When the check 114' is at its second position and the check control valve 84" is at its first position, the first and second effective areas, A1 and A2, are acted upon by the pressure resident in chambers 109 and 102, respectively, to hydraulically balance the forces on the check 114' and thereby allow the spring 116 to move the check 114' towards its first position.

A drain line 122 comprises a part of pressurizing means 20' and provides fluid communication between the check control valve 84" and a fluid barrier circuit 124 arranged in the housing **64*a*' about the plunger 60'. The fluid barrier circuit 124 constitutes a part of the pressurizing means 20' and includes an annular passage 126 of predetermined axial length, which encircles the plunger 60' and is open to the bore 66 at a longitudinal location above (from the perspective of FIGS. 3*a* and 3*b*), but near, the point of maximum retraction of the plunger 60'. A plunger drain line 134 constitutes a part of the pressurizing means 20' and fluidly connects the annular passage 126 to the fluid drain/passage 36 via the check guide chamber 98' and an injector drain line 136**.

The injector drain line 136 comprises a part of the injection means 22' and fluidly couples the check guide chamber 98' to the fluid drain/passage 36.

Figure 4:
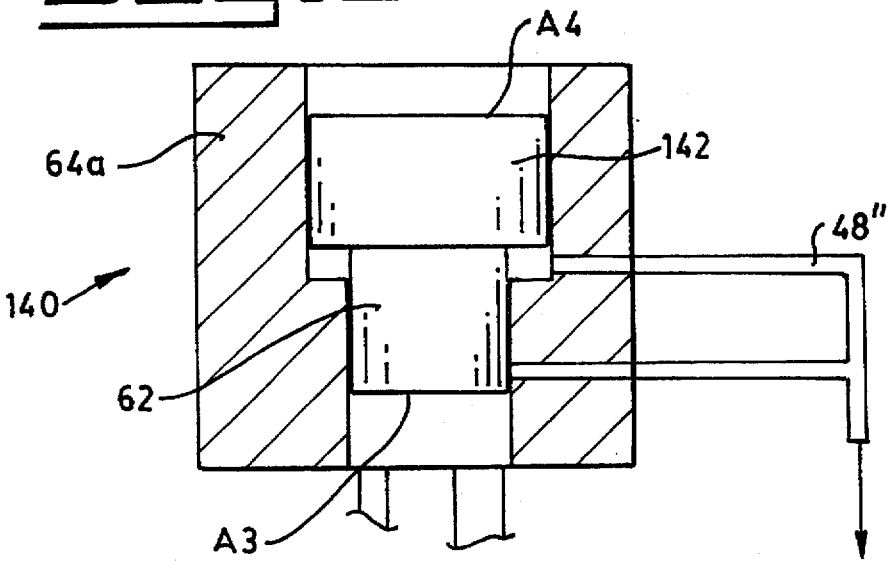
FIG. 4 is an elevation view of an amplifier slave piston structure which can be substituted for the slave piston shown in the embodiments of the other Figures.

FIG. 4 schematically illustrates an amplifier piston structure 140 which includes a slave piston 62 having a first predetermined area, A3, which is exposable to a first fluid (e.g. HFO) and an amplifier piston 142 having a second predetermined area, A4, which is exposable to a second fluid (e.g. control fluid) wherein A4 is advantageously greater than A3. The amplifier piston structure 140 finds greatest utility in the fuel systems 10, 10' illustrated in FIGS. 1*a*, 1*b*, 2*a*, and 2*b*. The amplifier piston structure 140 can be readily substituted for the slave piston 62 shown elsewhere herein. The amplifier piston structure 140, due to its component parts (142 and 62) occupying different sized bores in the housing 64*a*, is associated with a modified HFO drain/passage 48" which, if used, constitutes a portion of the HFO supply means 16 or 16' and communicates with the respective bores as shown.

Industrial Applicability

Prior to initiating an injection cycle for the fuel system 10, the following apparatus are in their first positions or states as shown in FIG. 1*a*: the actuator 80; the pressure control valve 82; the check control valve 84; the check 114; the plunger 60; and the slave piston 62.

Prior to initiating an injection cycle for the fuel system 10', the following apparatus are in their first positions or states as shown in FIG. 2*a*: the actuators 80*a'* and 80*b'*; the pressure control valve 82'; the check control valve 84'; the check 114; the plunger 60; and the slave piston 62.

Prior to initiating an injection cycle for the fuel system 10", the following apparatus are in their first positions or states as shown in FIG. 3*a*: the actuator 80; the pressure control valve 82"; the check control valve 84"; the check 114'; and the plunger 60'.

Preparatory to Initiating an Injection Cycle

In its first position the pressure control valve 82 of FIG. 1 provides fluid communication between the fluid supply passage 28*b* and the fluid control passage 72 to permit relatively low pressure control fluid from tank 26 to flow to and fill the pumping chamber 70 and, thereafter, to sequentially pass through the fluid passage circuit 74, and the drain passage 36 to the fluid tank 26.

In its first position the pressure control valve 82' of FIG. 2 provides fluid communication between the fluid supply/passage 28*b* and the pumping chamber 70 to enable relatively low pressure control fluid to sequentially fill the pumping chamber 70, the fluid supply passage 72, and the check control passage 92.

HFO is then drawn from the HFO tank 38 by the pump 42 and sequentially transmitted through the filter 44 and check valve 46 in FIGS. 1 and 2 to fill the injection chamber 76 and, thereafter, passes through the HFO drain passage 48 and returns to the HFO tank 38. The pressure from the HFO supply means 16 is, at this time in the injection sequence, greater than the pressure in the pumping chamber 70 to cause the slave piston 62 to move to its first position.

In its first position the check control valve 84" of FIG. 3 obstructs fluid communication between the fluid drain line 28*c"* and the fluid drain passage 36 causing high pressure fluid to be sequentially transmitted through the fluid supply passage 28", supply passages 28*a"* and 28*b"* to, respectively, check control chamber 102 and pressure control valve 82". Such high pressure fluid transmission holds the check 114' in its first position and ensures that the pressure control valve 82" is in its first, open position allowing HFO to be drawn from tank 38 by pump 42 and sequentially transmitted through the HFO supply passage 40', filter 44, valve 82", HFO supplemental supply/passage 41', and into the pumping chamber 70. When the plunger 60' is at its first position, the HFO fills the pumping chamber 70 and subsequently flows through the HFO drain passage 48' and returns to the HFO tank 38.

Initiating the Injection Cycle

To start the fuel injection cycle for the fuel injection systems 10, 10' and 10", the rotating cam 50 drives the plunger 60 in fuel systems 10 and 10' and 60' in fuel system 10" (downward as depicted) from its first position toward its second position. The profile of the cam 50 is preferably chosen to begin plunger movement (and thus fuel pressurization) in advance of fuel injection and, may, as desirable, continue plunger movement during actual fuel injection or maintain the plunger at a nearly constant position during actual fuel injection.

initial movement of the plunger 60 for fuel systems 10 and 10' causes the transverse passage 74*b* to move out of registry with vent passage 74*c* and, thereafter, block fluid communication between the pumping chamber 70 and the fluid drain passage 36. During subsequent movement of plunger 60 in fuel system 10, control fluid (preferably distillate fuel) is pumped from the pumping chamber 70 and, due to the plunger's greater pressure generating capability than the pump 30, sequentially through fluid passage 72, valve 82, passage 28*b*, relief line 37, relief valve 39, drain/passage 36, and into tank 26. During subsequent movement of plunger 60' in fuel system 10', control fluid is pumped from the pumping chamber 70 and, due to the plunger's greater pressure generation capability than the pump 30, sequentially through valve 82', passage 28*b*, relief line 37, relief valve 39, drain/passage 36, and into tank 26. During subsequent movement of plunger 60' in fuel system 10", HFO is pumped from the pumping chamber 70 and, due to the plunger's greater pressure generating capability than pump 44, sequentially through valve 82", supply passage 40', relief line 37', pressure relief valve 39', and into tank 38.

Initiating Pressurization of Fuel

At a selected amount of plunger movement for fuel system 10 (i.e. when the amount of distillate fuel remaining in the pumping chamber 70 will yield the desired injection pressure of HFO at the desired time of injection), the ECM 78 supplies a signal through the conductor 90 to the solenoid 80 to cause the solenoid 80 to change states from its first, unenergized state to its second, energized state. The energized solenoid 80 moves the check control valve 84 from its first position to its second position in the conventional, well known manner and, in the process of so moving, compresses the spring 88 which moves the pressure control valve 82 from its first to its second position and compresses the spring 86. The solenoid 80 is maintained in its energized state by the ECM 78 until pressure in the pumping chamber 70 and fluid control passage 72 reaches a magnitude sufficient to hold (hydraulically lock) the pressure control valve 82 in its second position against the force of spring 86 and is then deenergized by the ECM 78 by transmitting an appropriate signal through the conductor 90 which permits spring 88 to move the check control valve 84 to its first position.

At a selected amount of plunger movement for fuel system 10' (i.e. when the amount of distillate fuel remaining in the pumping chamber 70 will yield the desired injection pressure of HFO at the desired time of injection), the electronic control module 78 supplies a signal through the conductor 90*a'* to the solenoid 80*a'* to cause the solenoid 80*a'* to change states from its first, unenergized state to its second, energized state. The energized solenoid 80*a'* moves the pressure control valve 82' from its first position to its second position in the conventional, well known manner and, in the process of so moving, compresses the spring 86'. The solenoid 80*a'* is maintained in its energized state until pressure in the pumping chamber 70, fluid control passage 72, and check control passage 92 reaches a magnitude sufficient to hydraulically hold (locking pressure) the pressure control valve 82' in its second position due to the differential forces (from the opposing pressures) acting on different areas of the pressure control valve 82'. After the locking pressure is achieved, the ECM 78 transmits an appropriate signal through the conductor 90*a*' to cause the solenoid 80*a*' to assume its unenergized state.

At a selected amount of plunger movement for fuel system 10" (i.e. when the amount of HFO remaining in the pumping chamber 70 will yield the desired injection pressure at the desired time of injection), the electronic control module 78 supplies a signal through the conductor 90' to the solenoid 80 to cause the solenoid 80 to change states from its first, unenergized state to its second, energized state. The energized solenoid 80 moves the check control valve 84" from its first to its second position where it provides fluid communication between high pressure fluid drain line 28*c*" and the fluid drain passage 36. Such high pressure fluid draining through drain line 28*c*" causes the pressure in fluid supply passage 28*b*" to drop and, thus, permit the pressure control valve 82" to move from its first position to its second position under the biasing force of spring 86 in the conventional, well known manner.

Each check control valve 84 and 84', when occupying its first position, maintains fluid communication between the pumping chamber 70 and the check control chamber 102 and obstructs fluid communication between the check control chamber 102 and the fluid drain passage 36. In its first position the check control valve 84" obstructs fluid communication between the high pressure fluid drain line 28*c*" and the fluid drain passage 36.

Of course, the components of fuel systems 10 and 10" must be appropriately sized to prevent their checks 114,114' from moving to their second position (i.e. open) before the above described deenergization of the actuators associated with the check control valves or a separate armature during pressurization of the (as used in fuel system 10") HFO. Of course, use of a separate actuator for each of the pressure control valve and the check control valve obviates the need for such component sizing injection of HFO in the fuel systems 10, 10', and 10" is then prevented since the pressure force (from the control fluid) acting on A2 of the checks 114 and 114' plus the force of the spring 116 acting on the checks 114 and 114' (in the same direction) is greater than the pressure force acting on A1 of the checks 114 and 114' in the opposing direction (i.e. to open the checks 114 and 114'). Accordingly, the checks 114 and 114' are held in their first, closed position during pressure build up in their associated pumping chamber 70.

During such pressure build up in fuel systems 10 and 10', the slave piston 62 is driven downwardly by the pressure in the pumping chamber 70 to block fluid communication between the injection chamber 76 and the HFO drain passage 48 and cause increasing pressure in the injection chamber 76 and check guide chamber 98. As a result of such pressure increase, the check valve 46 closes to prevent HFO from being forced back through the HFO supply passage 40 into the HFO tank 38.

Initiation of HFO injection

To initiate injection of HFO in the fuel systems 10, 10', and 10", the state of the solenoids 80 and 80*b*' are again changed by the ECM 78 to their energized state causing the check control valves 84, 84', and 84'" to move from their first positions to their second positions. Such movement of the check control valves 84 and 84': (1) blocks fluid communication between the pumping chamber 70 and the check control chamber 102; and (2) opens fluid communication between the check control chamber 102 and the drain/passage 36. Such movement of the check control valve 84" opens fluid communication between the high pressure fluid drain line 28*c*" and the fluid drain passage 36 via the fluid barrier circuit 124.

Pressure in the check control chamber 102 then falls to permit HFO in the check guide chamber 98 (for fuel systems 10 and 10') and check injection chamber 109 (for fuel system 10") to hydraulically move the check 114 (for fuel systems 10 and 10') and check 114'(for fuel system 10") from their first, closed position to their second, injecting position against the force of the associated check spring 116.

HFO then, in fuel systems 10 and 10', flows sequentially from the injection chamber 76 through the injection passage 100, check guide chamber 98, and the fuel injection orifice(s) 108 into the engine's combustion chamber (not shown). In fuel system 10", HFO then flows sequentially from pumping chamber 70 through the injection passage 100', check injection chamber 109, and the fuel injection orifice(s) 108 into the engine's combustion chamber (not shown).

In addition, the reduction in fluid pressure in the check control chamber 102 of fuel systems 10 and 10' allows control fluid to flow sequentially from the fluid tank 26 through the supply passage 28*a*, the check valve 34, the check control chamber 102, check control passage 92, through check control valve 84 and 84', and into the fluid drain passage 36. The flow of control fluid through check control chamber 102 and check control passage 92 in fuel systems 10 and 10' flushes any HFO that may have leaked thereinto through the clearance between the check guide bore 96 and the check 114 and transports it to the tank 26. Likewise, a mixture of control fluid and HFO flow from the check guide chamber 98' through the drain 136 due to the pressure differential and, the pumping action of the check 114' reciprocating to start and stop HFO injection. Such mixture results from control fluid entry into the check guide chamber 98' from the plunger drain line 136 and from control fluid leakage and HFO leakage into the check guide chamber 98' from the check control chamber 102 and check injection chamber 109, respectively. The control fluid flows while HFO is injected through the fuel injection orifice(s) 108.

Stopping HFO Injection

To end fuel injection, the solenoids 80 and 80*b*' are moved to the de-energized state by the ECM 78 allowing the springs 88, 88', and 88", respectively, in fuel systems 10, 10', and 10" to move their associated check control valves 84, 84', and 84" from their second position to their first position. Such movement in fuel systems 10, 10' and 10" blocks fluid communication between the check control chamber 102 and the fluid drain/passage 36. Such movement in fuel systems 10 and 10' simultaneously opens fluid communication between the pumping chamber 70 and the check control chamber 102 to increase the pressure in the check control chamber 102. Such movement in fuel system 10" enables the high pressure fluid supply means 14' to increase the pressure in the check control chamber 102.

Force resulting from such pressure increases in the check control chamber 102, in addition to the biasing force of the springs 116, moves the checks 114 and 114' to their first, closed position to end fuel injection into the engine's combustion chamber.

Preferably, A1 and A2 are sized such that when the check control valves 84, 84', and 84" are at their first position, the net hydraulic force acting on the associated checks is effectively zero. In other words, the opposing fluid pressures in the check guide chamber 98 (of fuel systems 10 and 10') check injection chamber 109 (of fuel system 10") and in the check control chamber 102 associated with each when multiplied by the respective areas of the checks 114 and 114' to which such pressures are exposed, A1 and A2, provide equal and opposite forces. Therefore, the net force acting on each of the checks 114 and 114' is the force of the spring 116 which is chosen to control the velocity of the checks 114 and 114' as they move from their second to their first position. Such spring force is preferably chosen to be sufficiently high for adequate check response yet sufficiently low to avoid, during check closing, overstressing the checks 114 and 114' and their engagable seat structure 112 and 112' for all the fuel systems and the seating structure 110 for fuel systems 10 and 10'.

After fuel injection has ended for fuel systems 10, 10' and 10", the profile of cam 50 allows the plunger of each fuel system to be moved (upward as seen in the Figures) towards its first position by the tappet/plunger spring 68 by virtue of its interconnection with the tappet 48. As the plunger 60 in the fuel system 10 retracts towards its first position, the pressure in the pumping chamber 70 and all passages connected thereto decreases until the pressure of the fluid supply means 14, acting in concert with the force of the spring 86 overcomes the force of the spring 88 and moves the pressure control valve 82 from its second position to its first position. As the plunger 60 in the fuel system 10' retracts towards its first position, the pressure in the pumping chamber 70 and all passages connected thereto decreases until the fluid supply means 14 acting through fluid supply passage **28*b* and in concert with the force of the spring 86' overcomes the pressure force in the pumping chamber 70 and moves the pressure control valve 82' from its second position to its first position. As the plunger 60' in the fuel system 10',10" retracts towards its first position, the pressure in the pumping chamber 70 and all passages connected thereto decreases until the fluid supply means 14,14' acting in concert therewith through fluid supply passage 28*b*,28*b*" and against the force of the spring 86',86" moves the pressure control valve 82',82"** from its second position to its first position.

The slave piston 62 of systems 10 and 10' follows the plunger 60 as it retracts toward its first position. When the pressure within the injection chamber 76 falls below the pressure of the HFO supply means 16 during such plunger and slave piston retraction, the HFO pump 42 forces HFO through the check valve 46, refills the HFO injection chamber 76 with HFO, and pushes the slave piston 62 towards its first position where the injection chamber 76 becomes fluidly coupled with the HFO drain passage 48 and, thus, the HFO tank 38.

The resulting circulation of HFO through the injection chamber 76 improves engine startability by warming all parts of the injectors 12, 12' (due to the need for HFO to be heated to enable/improve its flowability) prior to operating the engine. Such HFO circulation path enables service flushing of the injector portions exposed to HFO with distillate fuel or other solvent after the engine has been shut off to remove any HFO deposits trapped within the injection chamber 76 or on the slave piston 62.

The amplifier piston structure 140, when substituted in the pressurizing means 20 for the slave piston 62, will provide greater pressure in the injection chamber 76 due to the pressure amplification effect provided by the area ratio A4/A3. Such pressure amplification, due to the greater size of the bore which houses A4, requires greater volumes of distillate fuel from the pumping chamber 70 than use of a slave piston 62 alone.

While the illustrated, preferred injectors 12, 12' each employs a non-contacting check closed orifice (NCCCO), it is to be understood that a conventional, check which closes the orifice 108 could also be used albeit with a greater potential for: damage to the tip 106; and/or reduced engine performance due to the larger spatial requirements necessitated by the inclusion of a cooling circuit on the nozzle tip 106. The major advantage of a NCCCO is that the primary seating structure 110 is located in an upper region of the injecting means 22 where componentry thereof has greater thickness and strength as compared with conventional injector seating structures and the secondary seating structure 112 to provide more effective sealing and seating of the check 114 when in its first position. Having the check's primary seating structure 110 separated from the nozzle tip 106 also results in that seating structure 110 being exposed to a much cooler portion of the utilizing engine's cylinder head which improves the life of the check 114 and the seating structure and eliminates the need for cooling circuits around the nozzle tip 106. The check 114, when in its first position, does not, preferably, contact the tip 106 but is dimensionally controlled to remain separated from the tip 106 so that very low or zero clearance is obtained between the check 114 and the tip 106 near the orifices 108. Since the check 114 does not contact the housing 64 at the tip 106, the tip cooling circuit can be eliminated for HFO applications.

Other aspects, objects, and advantages of this invention can be obtained from a study of the drawings, the disclosure, and the appended claims.

I claim:

1. An electronically controlled fuel injector comprising:

a housing having a check control chamber, a bore, and an injection chamber;

pressurizing means including a pressurizing chamber and a reciprocatable pressurizing member for pressurizing fuel in said pressurizing chamber, said pressurizing chamber being in fluid communication with a fuel supply means;

means for injecting fuel into an engine's combustion chamber including an orifice through the housing and a check reciprocatably disposed in the bore to move between a first position and a second position, said check having first and second ends, said first end having a control area in fluid communication with said check control chamber, said second end respectively obstructing and providing fluid communication through the orifice when said check in is its first and second position and including an opening area in fluid communication with said pressurizing chamber, said control area being continuously fluidly isolated from said second end; and control means for regulating pressure in the pressurizing chamber and in the control chamber.

2. The fuel injector of claim 1, said control means comprising:

a pressure control valve moveable between a first and a second position for respectively providing and obstructing fluid communication between the fuel supply means and said pressurizing chamber in response to being fluidly coupled to a high pressure control fluid source and a low pressure control fluid source, respectively; and means for moving said pressure control valve between its first and its second positions.

3. The fuel injector of claim 2, said control means further comprising:

a check control valve moveable between a first and a second position for respectively coupling the check control chamber to the high pressure control fluid source and the low pressure control fluid source; and means for moving said check control valve between its first and second positions.

4. The fuel injector of claim 2, wherein the control fluid comprises distillate fuel.

5. The fuel injector of claim 3 wherein said pressure control valve moves from its first to its second position in response to said check control valve moving from its first position to its second position.

6. The fuel injector of claim 3 wherein said check moves from its first to its second position in response to said check control valve moving from its first to its second position.

7. The fuel injector of claim 3 further comprising:

supply means for providing fluid communication between the high pressure control fluid source and the pressure control valve and the check;

drain means for providing fluid communication between the check control valve and the supply means; and restriction means for providing a rate of control fluid flow through said supply means which is less than the rate of control fluid flow through said drain means when said check control valve is in its second position.

8. The fuel injector of claim 3 further comprising:

a control fluid circuit disposed about and in fluid communication with said pressurizing member, said check control valve, and the low pressure control fluid source.

9. The fuel injector of claim 8 wherein said control fluid circuit is isolated from the pressurizing chamber.

10. A fuel injection system comprising:

a source of fuel;

a source of high pressure control fluid;

a pressurizing housing having a bore;

a plunger reciprocatably disposed in said bore to form, with said housing, a pressurizing chamber for pressurizing fuel therein;

an injecting housing having a check bore and an orifice providing fluid communication between the check bore and an engine combustion chamber, said check bore being in fluid communication with said pressurizing chamber;

a check reciprocatably disposed in said check bore to move between first and second positions, said check, in its first and second positions, respectively obstructing and providing fluid communication between said check bore and said orifice;

check control means for moving said check between its first and second positions, said check control means including a check control valve movable between a first and a second position; and pressure control means for selectively providing and obstructing fluid communication between said fuel source and said pressurizing chamber, said pressure control means including a pressure control valve movable between a first and a second position.

11. The fuel injection system of claim 10 wherein said check is responsive to said check control valve such that when said check control valve occupies its first position, said check occupies its first position and when said check control valve occupies its second position, said check occupies its second position.

12. The fuel injection system of claim 10 wherein said pressure control valve is responsive to said check control valve such that when said check control valve occupies its second position, said pressure control valve occupies its second position.

13. The fuel injection system of claim 11 wherein when said check control valve occupies its first position, said pressure control valve will occupy one of its first and second positions in response to the pressure in said pressurizing chamber.

14. The fuel injection system of claim 10 further comprising:

means for providing a greater rate of fluid communication between said check control valve and said check than between said control fluid source and said check.

15. The fuel injection system of claim 10 wherein said check and said pressure control valve are in open fluid communication.

16. A method of injecting fuel into an engine's combustion chamber comprising:

providing a fuel supply means, a high pressure control fluid supply means having a supply passage and drain, a pressure control valve movable between a first, fuel conducting position and a second, fuel obstructing position, a check control valve movable between a first, fluid obstructing position and a second, fluid conducting position, and a check control chamber;

moving a plunger within a housing in a first direction to expel fuel from a pressurizing chamber to the fuel supply means;

providing fluid communication between the drain and a pressure control valve to move said pressure control valve to its second position;

after a predetermined pressure is reached in the pressurizing chamber to hold the pressure control valve in its second position, providing fluid communication between the supply passage and the pressure control valve;

providing fluid communication between the drain and the check control chamber which is in fluid communication with a control surface disposed on a check to move the check from a first position in which fuel flow from said pressurizing chamber through said orifice is obstructed to a second position in which fuel flow from the pressurizing chamber through the orifice is permitted;

providing fluid communication between the supply passage and the check control chamber to move said check to its first position;

providing fluid communication between the supply passage and the pressure control valve; and moving the plunger in a second direction to depressurize fuel in the pressurizing chamber.

* * * * *